US009347732B2

(12) United States Patent
Bidigare et al.

(10) Patent No.: US 9,347,732 B2
(45) Date of Patent: May 24, 2016

(54) APPARATUS FOR MOUNTING A DAMPENER AND/OR STABILIZER TO AN ARCHERY BOW

(71) Applicant: K TECH DESIGNS, L.L.C., Flint, MI (US)

(72) Inventors: Eric C Bidigare, Flint, MI (US); Kerry A Verran, Davison, MI (US)

(73) Assignee: K TECH DESIGNS, L.L.C., Flint, MI (US)

( * ) Notice: Subject to any disclaimer, the term of this patent is extended or adjusted under 35 U.S.C. 154(b) by 0 days.

(21) Appl. No.: 14/519,633

(22) Filed: Oct. 21, 2014

(65) Prior Publication Data

US 2015/0034063 A1 Feb. 5, 2015

Related U.S. Application Data

(63) Continuation-in-part of application No. 13/604,972, filed on Sep. 6, 2012, now Pat. No. 9,032,947.

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
See application file for complete search history.

(56) References Cited

U.S. PATENT DOCUMENTS 3,412,725 A * 11/1968 Hoyt, Jr. ..... 124/84
3,670,712 A 6/1972 Izuta
5,090,396 A 2/1992 Bickel et al.
5,611,325 A 3/1997 Kudlacek
5,657,741 A * 8/1997 Todd ..... 124/89
5,911,215 A * 6/1999 Fisher, Jr. ..... 124/86
D442,251 S 5/2001 Fitzgerald, Jr.
D446,278 S 8/2001 Fitzgerald, Jr.
D448,827 S 10/2001 Chipman
6,382,201 B1 5/2002 McPherson et al.
6,431,163 B1 * 8/2002 Chipman ..... 124/89
6,675,793 B1 * 1/2004 Saunders ..... 124/89
6,745,757 B2 6/2004 Sims
7,264,098 B2 9/2007 McPherson
7,278,216 B2 10/2007 Grace
7,318,430 B2 1/2008 Leven
7,610,686 B1 11/2009 Summers et al.
7,987,954 B2 8/2011 McPherson
8,225,778 B2 7/2012 Walk et al.
2010/0192932 A1 8/2010 Brewster (Continued)

*Primary Examiner* — John Ricci
(74) *Attorney, Agent, or Firm* — Young Basile Hanlon & MacFarlane P.C.

(57) ABSTRACT

An apparatus for absorbing energy from the release of an archery bow. The apparatus of the present invention provides an elongated support structure releasably connectable to a vibration reduction insert. The vibration reduction insert has a substantially cylindrical shape and at least one substantially C-shaped recess along an outer edge of the vibration reduction insert. A releasable fastener is connected to one end of the support structure, and the fastener is releasably connectable to the archery bow such that the support structure is extendible in a cantilevered position relative to the archery bow. The vibration reduction insert may be made from a vibration reduction material. Along an edge of the C-shaped recess, the vibration reduction insert may have a U-shaped recess that extends toward the radial center of the vibration reduction insert. There may be two substantially C-shaped recesses that are substantially coaxially aligned.

20 Claims, 9 Drawing Sheets

(56) References Cited

U.S. PATENT DOCUMENTS

2010/0326415 A1 12/2010 Walk et al.
2011/0120440 A1 5/2011 Stokes
2012/0125310 A1 5/2012 Khoshnood

* cited by examiner

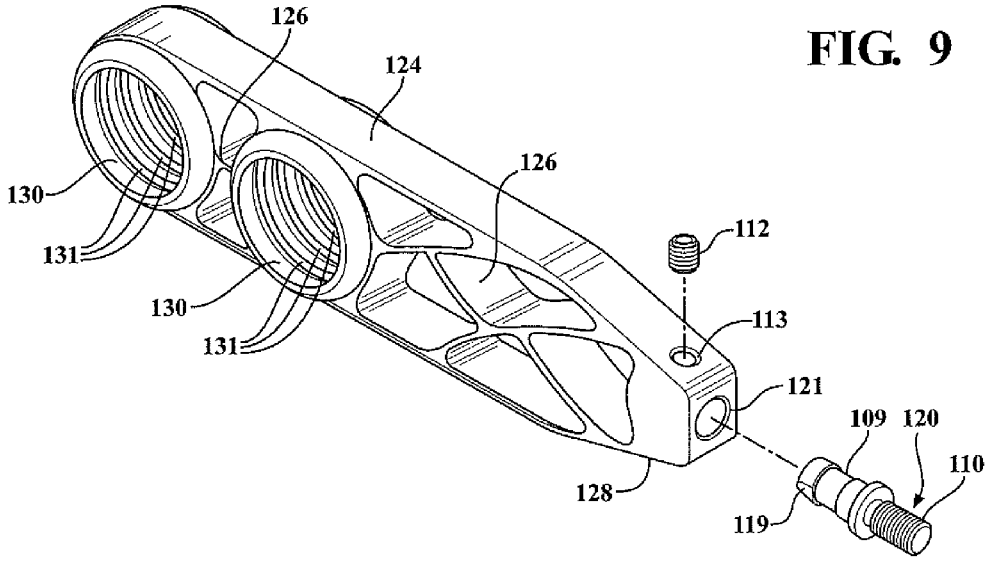
FIG. 9
FIG. 10
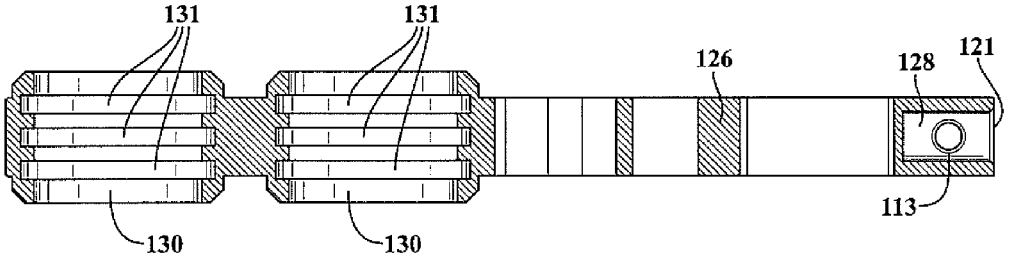

APPARATUS FOR MOUNTING A DAMPENER AND/OR STABILIZER TO AN ARCHERY BOW

CROSS-REFERENCE TO RELATED APPLICATION

This patent application is a continuation-in-part of U.S. patent application Ser. No. 13/604,972, filed Sep. 6, 2012.

FIELD OF THE INVENTION

The present invention relates to the use of dampeners and/or stabilizers in an archery bow and, in particular, various structures for releasably mounting at least one dampener and/or stabilizer to an archery bow for effectively absorbing energy from the release of the archery bow.

BACKGROUND OF THE INVENTION

The archery bow is a simple mechanical device used to store energy derived from the archer during the drawing of the archery bow. When the archer releases the bow string or cable, the archery bow's energy is rapidly released. The greater portion of this energy is spent on launching the arrow, and much of the remaining energy is directed to the archery bow wherein the excess energy results in noise or is simply lost in the transfer process. Some of the energy directed back into the archery bow returns to its original undrawn state; however, much of this energy goes into excessive movement of various archery bow components, resulting in archery bow hand shock and system vibrations.

Because the trajectory of the arrow may be affected by any movement or vibration of the archery bow during the arrow's launch, it is desirable to reduce and/or eliminate such vibrations to the greatest extent possible by absorbing the energy in the archery bow. Thus, stabilizers and dampeners for archery bows have been designed and utilized in the archery field for many years. Such stabilizers and dampeners help absorb the shock and vibration that occur during the launch and release of an arrow from the archery bow.

Certain shock and vibration dampening devices have been created using lightweight materials, such as rubber and plastics. These devices have been mounted directly to the archery bows in an attempt to absorb such shock and vibration from the archery bow. However, the placement of these devices on the archery bow can be critical as to how well the dampening device operates. Many of these shock and dampening devices are mounted permanently to the archery bow, and therefore, the dampening device cannot be moved or changed. This is a disadvantage since an archer is unable to change the location or type of dampening device based on the performance characteristics of the dampening device.

Thus, it would be desirable to provide an apparatus that allowed for the effective and removable mounting of a dampener and/or stabilizer to an archery bow for absorbing energy from a released archery bow.

SUMMARY OF THE INVENTION

The present invention provides an apparatus for absorbing energy from the release of an archery bow. The apparatus of the present invention provides an elongated support structure releasably connectable to at least one vibration reduction insert. Each of the vibration reduction inserts have a substantially cylindrical shape and at least one substantially C-shaped recess along an outer edge of the vibration reduction insert. A releasable fastener is connected to one end of the support structure, and the fastener is releasably connectable to the archery bow such that the support structure is extendible in a cantilevered position relative to the archery bow.

The support structure of the present invention may have a substantially oval configuration having an outer frame with cross supports extending across the frame. The frame and the cross supports may be connectable to the vibration reduction inserts. The cross supports may have a honeycomb configuration, a cross-hatch configuration, or an arched cross-hatch configuration.

The vibration reduction insert may be made from a vibration reduction material. Along an edge of the C-shaped recess, the vibration reduction insert may have a U-shaped recess that extends toward the radial center of the vibration reduction insert. There may be two substantially C-shaped recesses and the C-shaped recesses may be substantially coaxially aligned. Each of the C-shaped recesses may have a substantially U-shaped recess that is substantially coaxially aligned with the other U-shaped recess. The vibration reduction insert may include a plurality of adjoining, solid discs that are coaxially aligned.

BRIEF DESCRIPTION OF THE DRAWINGS

The various features, advantages and other uses of the present apparatus will become more apparent by referring to the following detailed description and drawings in which:

FIG. 9 is an exploded perspective view of the present invention showing the support structure having cross-supports with the arched cross-hatch configuration, a fastener, and a set screw;

FIG. 10 is a cross-sectional view of the present invention showing two apertures, each having three annular grooves;

DETAILED DESCRIPTION

Figure 1:
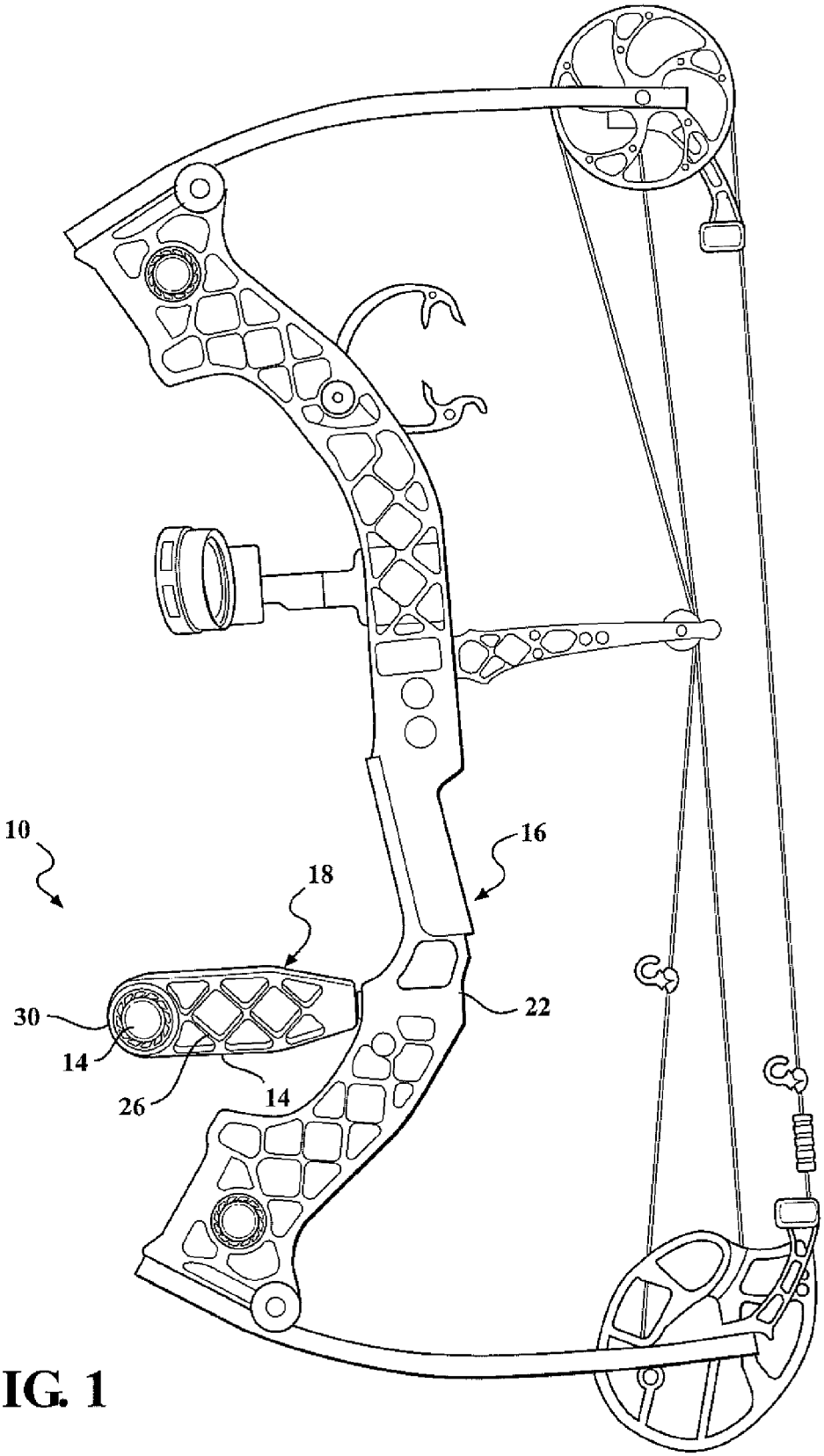
FIG. 1 is a front plan view of the apparatus for mounting the dampener and/or stabilizer to an archery bow of the present invention connected to an archery bow.

Referring to the drawings, the present invention will now be described in detail with reference to the disclosed embodiments.

As seen in FIGS. 1-6, the present invention provides an apparatus 10 for releasably mounting at least one dampener 12 and/or at least one stabilizer 14 to an archery bow 16. The archery bow 16 may include a conventional compound archery bow 16 as shown in FIG. 1; however, the apparatus 10 may be utilized in conjunction with other archery bows that may benefit from the absorption of shock and vibration as provided by the present invention. The apparatus 10 of the present invention provides an elongated support structure 18 for supporting at least one of the dampeners 12 and/or the stabilizers 14. The dampener 12 and the stabilizer 14 are conventional, such as those manufactured and sold by Matthews, Inc. of Sparta, Wis. Such conventional dampeners 12 and stabilizers 14 may be fabricated from a rubber spoked housing having an alloyed metal core centered in the rubber housing. The dampeners 12 and the stabilizers 14 are designed to absorb the residual energy in the archery bow 16. To effectively position the apparatus 10 on the archery bow 16, a fastener 20 is connected to one end of the elongated support structure 18 in order to releasably connect the apparatus 10 to the archery bow 16. A threaded aperture (not shown) may be provided in a body portion 22 of the archery bow 16, and the fastener 20 on the support structure 18 may be threaded into the threaded aperture provided in the body portion 22 of the archery bow 16. The apparatus 10 extends outward from the body portion 22 of the archery bow 16 in a cantilevered position relative to the archery bow 16. The position and design of the apparatus 10 allows an archer to remove and attach various embodiments of the apparatus 10 to the archery bow 16 while also assuring that the apparatus 10 does not affect the archer from operating the archery bow 16 and ensuring that the position of the apparatus 10 does not affect the archer's vision when operating the archery bow 16. Through experimental use, it has been determined that the disclosed embodiments of the present invention provide an effective apparatus for absorbing shock and vibration from the release of the archery bow 16.

Figure 2:
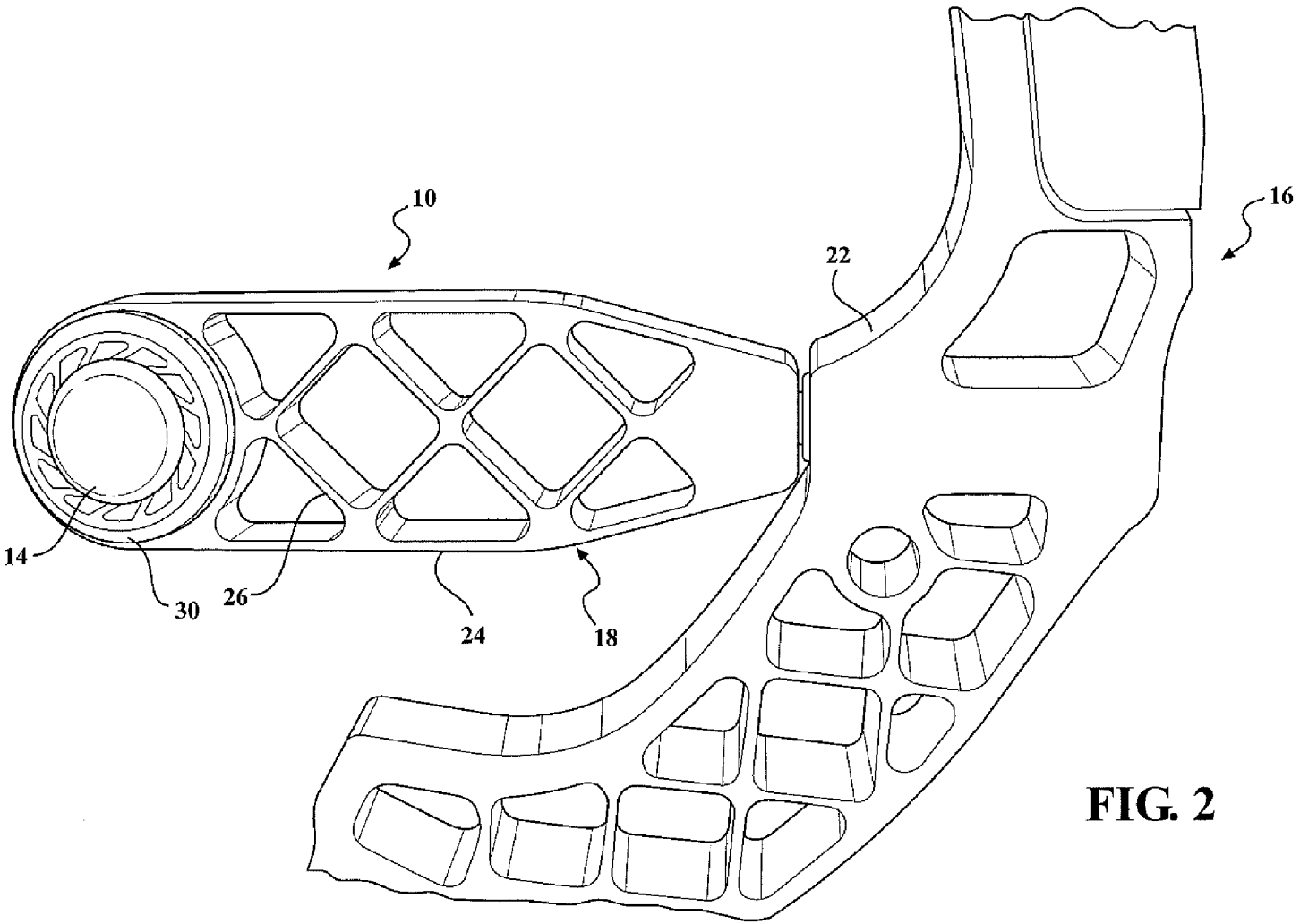
FIG. 2 is a schematic view of the present invention showing the support structure having cross supports with a honeycomb configuration.
Figure 3:
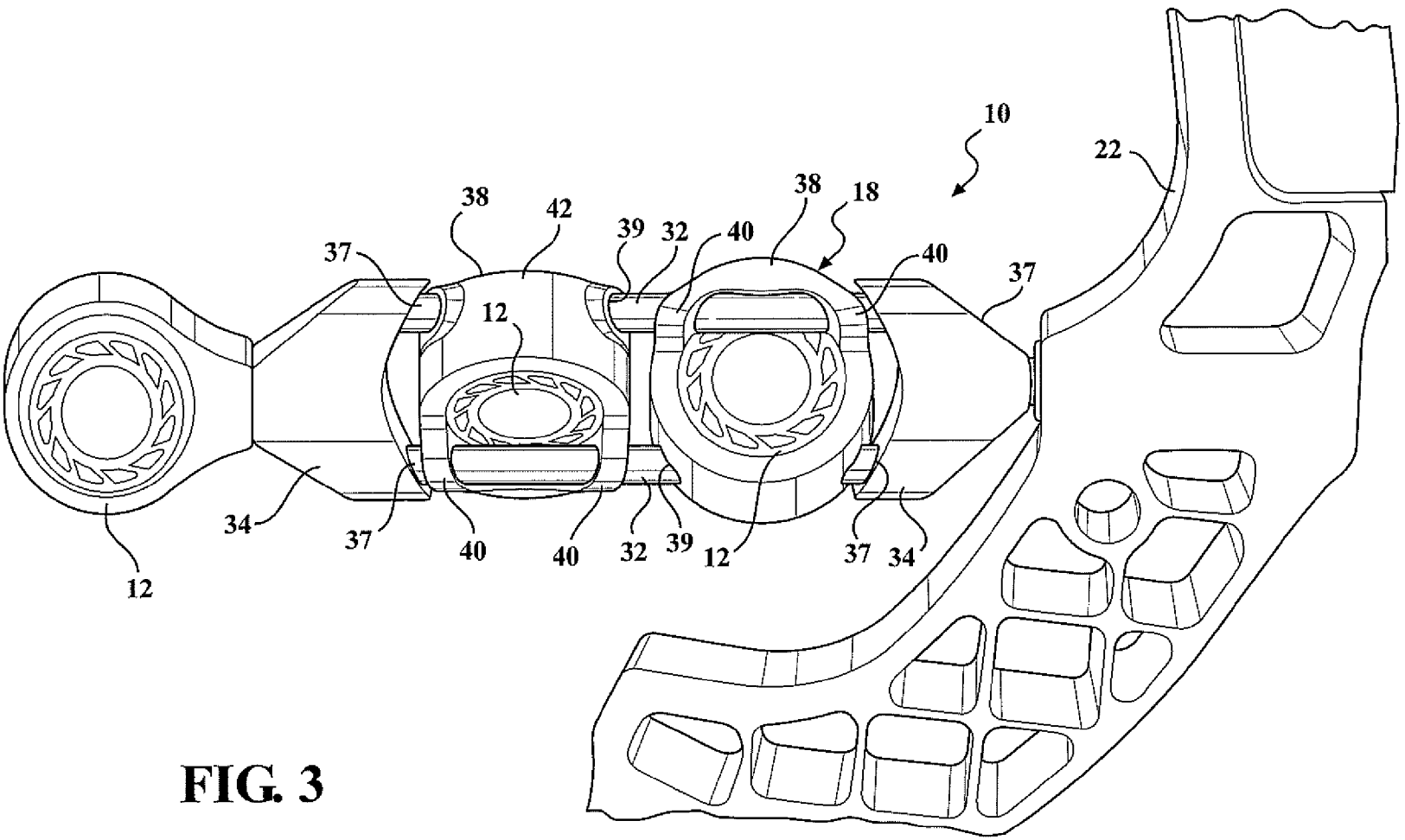
FIG. 3 is a schematic view of the present invention showing the support structure having a pair of rods.
Figure 4:
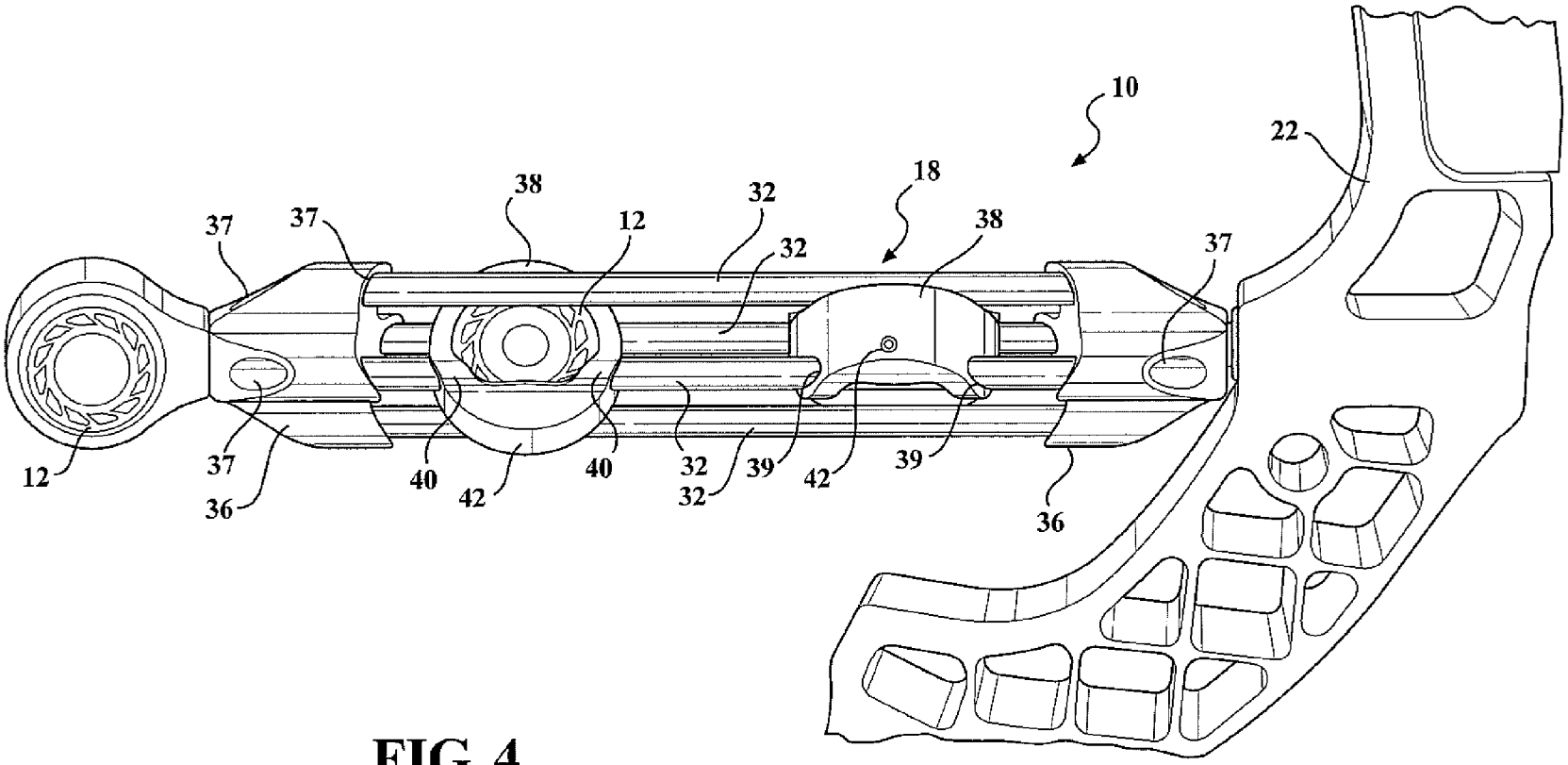
FIG. 4 is a schematic view of the present invention showing the support structure having four rods.

In order to mount the dampener 12 and/or the stabilizer 14 in a position that will effectively absorb residual energy from the archery bow 16, the apparatus 10 of the present invention provides several embodiments. As seen in FIGS. 1-2, a first embodiment of the present invention provides the support structure 18 of the apparatus 10 with a substantially oval configuration having an outer frame 24 that outlines the support structure 18. The support structure 18 also has various cross-members 26 that are defined by various voids or apertures that extend through the support structure 18. The cross-members 26 essentially extend between the outer frame 24 so as to support the support structure 18 in a rigid manner. The cross-members 26 and the outer frame 24 of the support structure 18 may also be utilized to form at least one substantially circular aperture 30 provided in the support structure 18. Each of the apertures 30 receives either the dampener 12 or the stabilizer 14. A snap fit is provided between the dampener 12 or the stabilizer 14 and the aperture 30 to releasably secure the dampener 12 and/or the stabilizer 14 in the apparatus 10. The snap fit provided between the aperture 30 and the dampener 12 or the stabilizer 14 may utilize any conventional friction fit. This allows an archer to customize the apparatus 10 by interchanging various dampeners 12 and stabilizers 14 having different absorption and dampening characteristics. The cross-members 26 of the support structure 18 may provide a honeycomb or cross-hatch configuration. The support structure 18 may be fabricated from a lightweight, high strength material, such as a plastic or other similar polymeric materials. The apparatus 10 of the present invention may utilize any number or combination of the dampeners 12 and/or the stabilizers 14.

In another embodiment, the support structure 18 of the apparatus 10 of the present invention may utilize a plurality of substantially cylindrical rods 32 connected to a pair of end caps 34, 36. The end caps 34 shown in FIG. 3 have a substantially U-shaped configuration for receiving a pair of the rods 32 in a substantially parallel configuration. The end caps 36 shown in FIG. 4 may have a substantially pyramidal configuration for receiving four of the rods 32 in a substantially parallel configuration. Each of the end caps 34, 36 provides apertures 37 for receiving the ends of the rods 32. A boss (not shown) may be formed within the apertures 37 of the end caps 34, 36, wherein a fastener (not shown) is inserted into each of the apertures 37. The fastener is threaded into the ends of the rods 32 to secure the rods 32 within the end caps 34, 36. One of the end caps 34, 36 has the fastener 20 connected thereto for releasably connecting the apparatus 10 to the archery bow 16. The fastener 20 has a threaded stud configuration connected to the end cap 34, 36. The end caps 34, 36 at the opposite end of the support structure 18 provide a threaded aperture for receiving a threaded fastener connected to the dampener 12 or the stabilizer 14. This allows the dampener 12 or the stabilizer 14 to be positioned on the open end of the support structure 18. At least one of the dampeners 12 and/or the stabilizers 14 may be connected to the rods 32 between the end caps 34, 36.

Specialized outer casings 38 may be provided for securing the dampener 12 and/or the stabilizer 14 to the rods 32. The casings 38 are substantially cylindrical and allow the dampener 12 or the stabilizer 14 to snap into and out of the casing 38. The casings 38 have an aperture 39 extending there through for receiving one of the rods 32. A pair of bosses 40 having an aperture extending there through are integrally formed on the casing 38 for allowing a second rod 32 to extend through the casing 38. A set screw 42 may be provided in the casing 38 wherein the set screw 42 is threaded against the rod 32 to secure the casing 38 in a set position relative to the rods 32. The casings 38 may be mounted at various angles and at a various longitudinal spacing with respect to the rods 32 to provide various energy-absorbing characteristics. The rods 32 may be fabricated from any high strength, lightweight material, such as various polymeric and metallic materials, and the end caps 34, 36 and the casings 38 may be formed of any high strength, lightweight material, such as polymeric materials.

Figure 5:
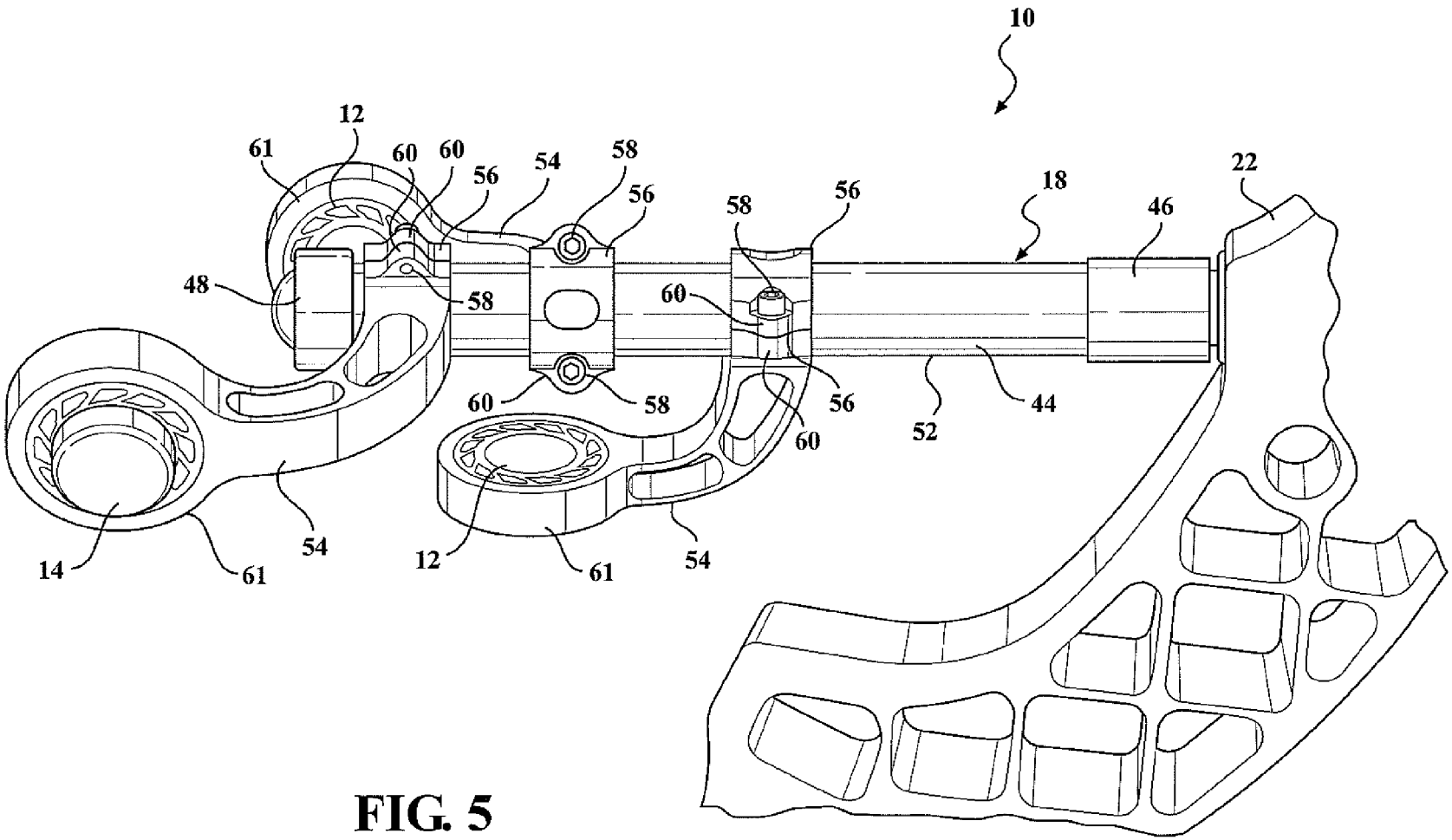
FIG. 5 is a perspective view of the present invention showing the support structure having a rod and brackets connected thereto.
Figure 6:
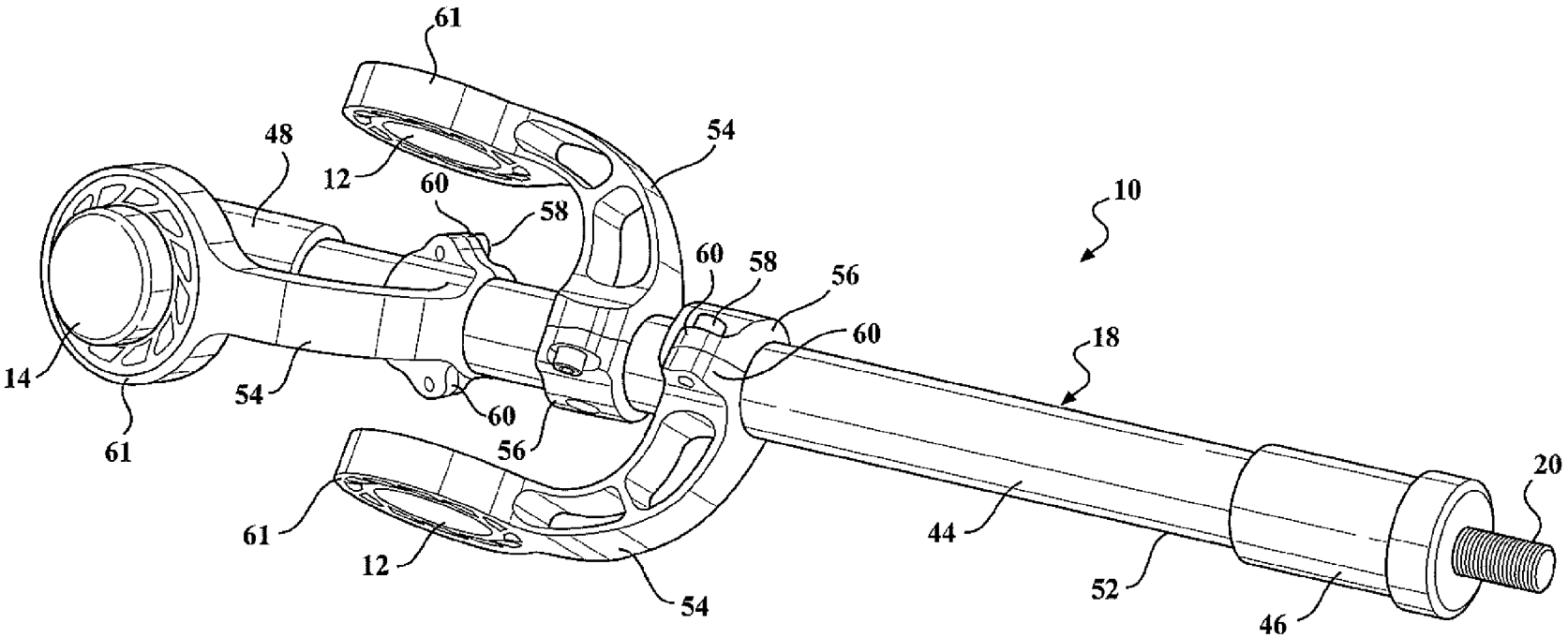
FIG. 6 is a perspective view of the present invention showing the support structure having a rod connected to an archery bow.

In yet another embodiment, the support structure 18 of the apparatus 10 of the present invention may provide an elongated cylindrical rod 44 having a pair of end caps 46, 48 connected to each end of the rod 44, as seen in FIG. 5-6. The end cap 46 has the fastener 20 connected to the end of the end cap 46 to allow the apparatus 10 to be removably connected to the threaded aperture in the archery bow 16. A braided metallic overlay 52 may be connected to the outer surface of the rod 44.

To secure at least one of the dampeners 12 and/or the stabilizers 14 to the apparatus 10, the support structure 18 of the apparatus 10 may provide arcuate shaped brackets 54 connected to the rod 44. One end of the brackets 54 has a substantially cylindrical configuration that is formed by a pair of semi-circular portions 56 that overlap and are connected to the rod 44. The pair of semi-circular portions 56 of the bracket 54 is secured to the rod 44 through the use of a pair of conventional fasteners 58 that extend through corresponding apertures provided in bosses 60 formed on each of the pair of semi-circular portions 56 of the bracket 54. By loosening and tightening the fasteners 58 on the bracket 54, the position of the bracket 54, and thus the position of the dampeners 12 and the stabilizers 14, can be adjusted along a longitudinal axis of the rod 44 and can be rotated with respect to the longitudinal axis of the rod 44. At the opposite, free end 61 of the bracket 54, an aperture is integrally formed in the bracket 54 for receiving the dampener 12 and/or the stabilizer 14. A snap fit or friction fit is provided in the aperture in the free end 61 of the bracket 54 for connecting the dampener 12 and/or the stabilizer 14 to the bracket 54. This also allows the archer to replace the dampener 12 and/or the stabilizer 14 with dampeners 12 and/or stabilizers 14 having the desired performance characteristics. The rod 44, the end caps 46, 48, and the brackets 54 may be fabricated from a lightweight, high strength material, such as a metallic or a polymeric material.

In use, the archer selects the apparatus 10 and threadably connects one of the embodiments of the apparatus 10 of the present invention to the archery bow 16. The archer may exchange the dampeners 12 and/or the stabilizers 14 with various other dampeners 12 and stabilizers 14 to provide various energy absorption characteristics in the archery bow 16. In addition, the archer may position the dampeners 12 and/or the stabilizers 14 in various positions, depending on the embodiment utilized in the present invention and depending on the desired characteristic of the apparatus 10.

In another embodiment of the present invention, the apparatus 10 may provide an arched cross-hatch configuration and/or a vibration reduction insert 105. As seen in FIGS. 7-10, this embodiment of the apparatus 10 may provide the support structure 18 of the apparatus 10 with a substantially oval configuration having an outer frame 124 that outlines the support structure 18. The support structure 18 may be fabricated from a lightweight, high strength material, such as a plastic or other similar polymeric material. One end 128 of the support structure 18 may provide two apertures 113, 121 having longitudinal axes that are substantially perpendicular to one another. The first aperture 121 may receive a fastener 120 to secure the apparatus 10 to the archery bow 16, and the second aperture 113 may threadably receive a set screw 112 to secure the fastener 120 to the apparatus 10. The fastener 120 has a head 109 and a threaded portion 110 that are integrally connected and substantially coaxially aligned. The head 109 of the fastener 120 may be received by the first aperture 121 and may have a pair of opposing, substantially flat regions 119 that align with and are engaged by the end of the set screw 112. The set screw 112 engages the flat region 119 to prevent the fastener 120 from rotating and exiting the first aperture 121. The threaded portion 110 of the fastener 120 extends beyond the first aperture 121 and the support structure 18 to engage the substantially cylindrical threaded aperture provided in the body portion 22 of the archery bow 16.

Figure 7:
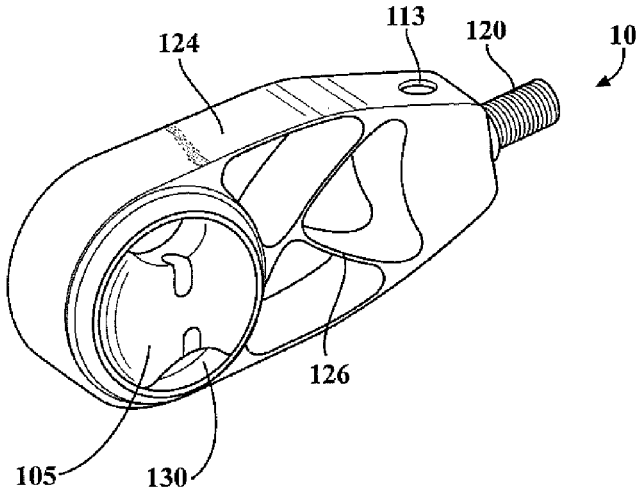
FIG. 7 is a perspective view of the present invention showing the support structure having cross-supports with an arched cross-hatch configuration and a vibration reduction insert.
Figure 8:
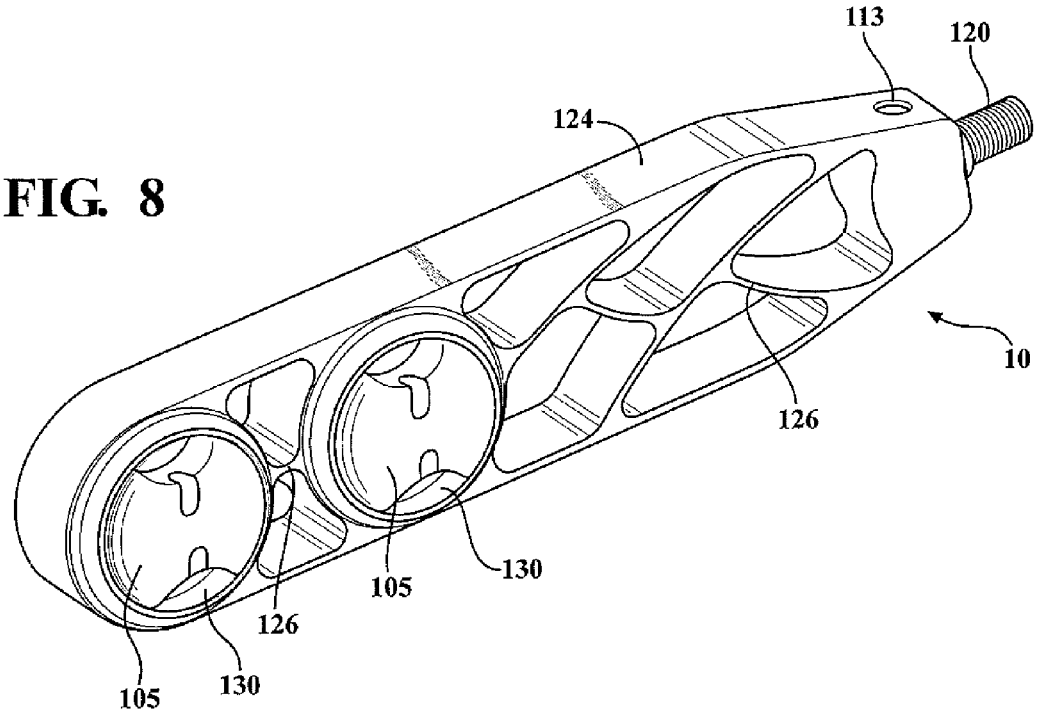
FIG. 8 is a perspective view of the present invention showing the support structure having cross-supports with the arched cross-hatch configuration and two vibration reduction inserts.

The support structure 18 may have various cross-members 126 that are defined by various voids or apertures that extend through the support structure 18. The cross-members 126 extend between the outer frame 124 and create a substantially arched cross-hatch configuration, wherein the cross-members 126 are substantially curvilinear. The cross-members 126 and the outer frame 124 of the support structure 18 may also be utilized to form at least one substantially circular aperture 130 provided in the support structure 18. FIG. 7 shows the apparatus 10 with one aperture 130, and FIGS. 8-10 show the apparatus 10 with two apertures 130, but it should be noted that the present invention is not limited to one or two apertures 130, but rather, other numbers of apertures 130 could be used. Cross-members 126 may be used between the apertures 130 when more than one aperture 130 exists. Each of the apertures 130 may be provided with a plurality of annular grooves 131 that are axially spaced, substantially coaxially aligned, and integrally formed thereon for receiving the vibration reduction insert 105. Although three annular grooves 131 are shown in FIGS. 9-10, the present invention is not limited to three annular grooves 131, but rather, other numbers of annular grooves could be used.

Figure 11:
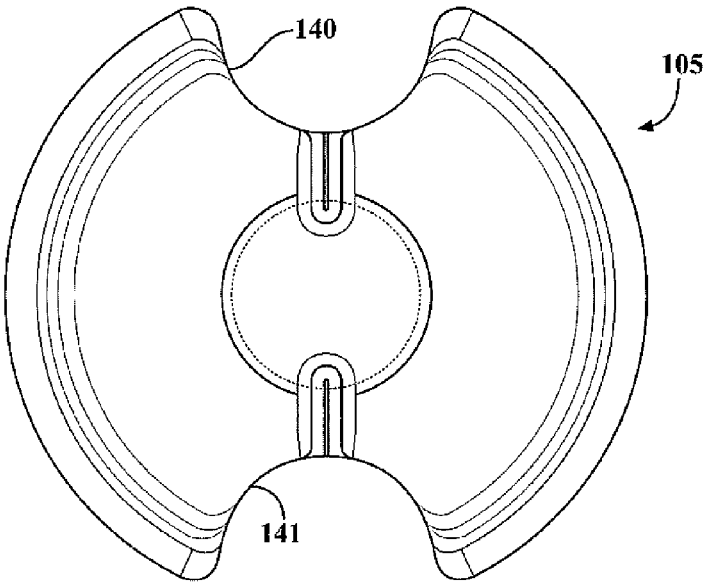
FIG. 11 is a front plain view of the vibration reduction insert.
Figure 12:
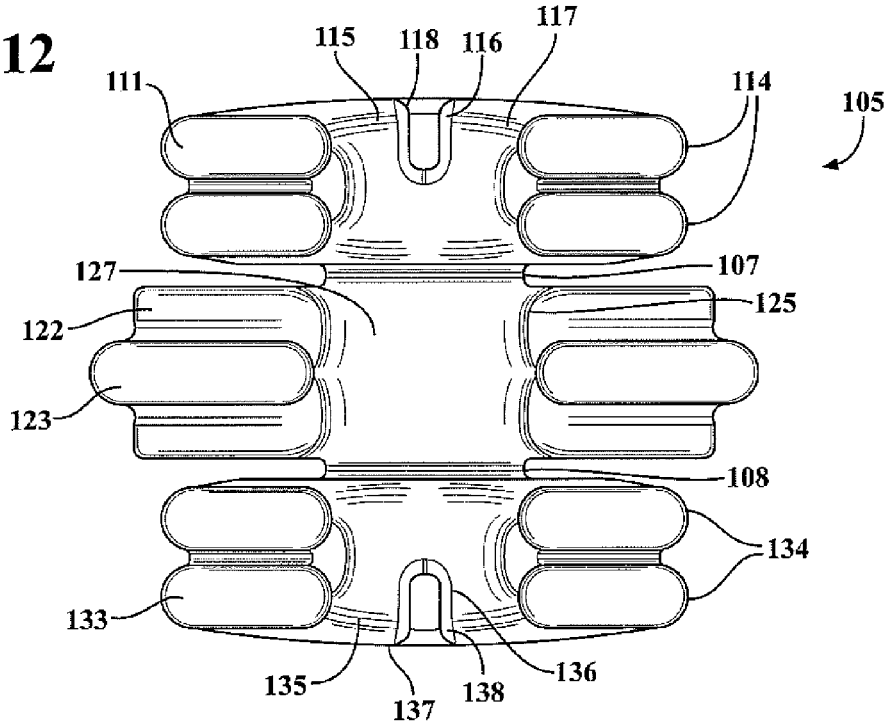
FIG. 12 is a top plain view of the vibration reduction insert.

The vibration reduction insert 105 is solid, substantially cylindrical, and is made of a vibration reduction material, such as rubber or plastic, as seen in FIGS. 11-12. The vibration reduction insert 105 is divided into a first portion 111, a second portion 122, and a third portion 133, which are in substantially coaxial alignment with one another. The radial centers of the first portion 111 and the second portion 122 are adjoined by a first solid connecting disc 107, and the radial centers of the second portion 122 and the third portion 133 are adjoined by a second solid connecting disc 108. The first portion 111 and the third portion 133 are substantially similar, each having a pair of adjoined solid discs 114, 134 that are substantially coaxially aligned. Each pair of solid discs 114, 134 are defined by a pair of opposing substantially C-shaped recesses 115, 135 and a pair of opposing substantially U-shaped recesses 116, 136. The pair of C-shaped recesses 115, 135 are formed in an outer edge 117, 137 of the solid discs and are located on opposite sides of the solid discs 114, 134, such that the pair of C-shaped recesses 115, 135 are substantially coaxial. The U-shaped recesses 116, 136 are formed in an outer edge 118, 138 of the C-shaped recesses 115, 135 and are located on opposite sides of the solid discs 114, 134, such that the U-shaped recesses 116, 136 are substantially coaxial.

The second portion 122 of the vibration reduction insert 105 is a disc having an annular ridge 123 protruding near the middle. When the vibration reduction insert 105 is inserted into the aperture 130 in the support structure 18, the annular ridge 123 engages one of the annular grooves 131 in the aperture 130 to secure the vibration reduction insert 105 within the aperture 130. A pair of substantially C-shaped recesses 125 are formed in an outer edge 127 of the second portion 122 and are located on opposite sides of the second portion 122, such that the pair of C-shaped recesses 125 are substantially coaxial. The C-shaped recesses 115, 125, 135 of the first portion 111, the second portion 122, and the third portion 133 are coaxially aligned, which define two recesses 140, 141 extending longitudinally through the vibration reduction insert 105 that assist with insertion/removal of the vibration reduction insert 105 in the aperture 130 by allowing the archer to position his or her fingers in the recesses 140, 141 while the vibration reduction insert 105 is in the aperture 130.

Similar to the other embodiments, this embodiment is not limited to one or two vibration reduction inserts 105, but rather, other numbers or combinations of the vibration reduction inserts 105 may exist. This allows an archer to customize the apparatus 10 by interchanging various vibration reduction inserts 105 having different absorption and dampening characteristics. To use, the archer selects the desired configuration of the apparatus 10 and inserts the vibration reduction inserts 105 into the apertures 130 in the support structure 18. Depending on the desired positioning of the vibration reduction insert 105, the annular ridge 123 on the vibration reduction insert 105 can engage any of the annular grooves 131 in the support structure 18. To enable attachment of the apparatus 10 to the archery bow 16, the head 109 of the fastener 120 is inserted into the first aperture 121 in the support structure 18 and secured to the support structure 18 through the use of the set screw 112 in the second aperture 113. Once assembled, the apparatus 10 is threadably connected to the archery bow 16 by engaging the threaded portion 110 of the fastener 120 with the threaded aperture in the archery bow 16. When attached, the apparatus 10 extends outward from the body portion 22 of the archery bow 16 in a cantilevered position relative to the archery bow 16. The apparatus 10 is ideally suited to be used in the same vertical plane as the archery bow 16, wherein the longitudinal axis of the fastener 120 is substantially perpendicular to the longitudinal axis of the vibration reduction insert 105; however, the apparatus 10 may be used in other positions as well.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for absorbing energy from the release of an archery bow, comprising:

an elongated support structure releaseably connectable to at least one vibration reduction insert;

the at least one vibration reduction insert having a substantially cylindrical shape and having at least one substantially C-shaped recess along an outer edge of the at least one vibration reduction insert; and a releasable fastener connected to one end of the support structure, and the fastener releaseably connectable to the archery bow such that the support structure is extendible in a cantilevered position relative to the archery bow, wherein the at least one vibration reduction insert is releaseably connected to the elongated support structure in a friction fit.

2. The apparatus as stated in claim 1, wherein the at least one vibration reduction insert is made from a vibration reduction material.

3. The apparatus as stated in claim 1, the at least one vibration reduction insert further comprising:

at least one substantially U-shaped recess along an edge of the at least one substantially C-shaped recess extending toward the radial center of the at least one vibration reduction insert.

4. The apparatus as stated in claim 1, wherein the at least one vibration reduction insert has two substantially C-shaped recesses along an outer edge of the at least one vibration reduction insert.

5. The apparatus as stated in claim 4, wherein the two substantially C-shaped recesses are substantially coaxially aligned.

6. The apparatus as stated in claim 5, the vibration reduction insert further comprising:

a substantially U-shaped recess along an edge of each of the substantially C-shaped recesses extending toward the radial center of the vibration reduction insert.

7. The apparatus as stated in claim 6, wherein the substantially U-shaped recesses are substantially coaxially aligned.

8. The apparatus as stated in claim 1, the vibration reduction insert further comprises:

a plurality of adjoining, solid discs that are substantially coaxially aligned, the at least one substantially C-shaped recess extends through each of the plurality of adjoining, solid discs.

9. The apparatus as stated in claim 8, the at least one vibration reduction insert has two substantially C-shaped recesses along an outer edge of the at least one vibration reduction insert, the two substantially C-shaped recesses are substantially coaxially aligned.

10. The apparatus as stated in claim 9, the at least one vibration reduction insert further comprises:

a substantially U-shaped recess along an edge of each of the substantially C-shaped recesses extending toward the radial center of the at least one vibration reduction insert, the substantially U-shaped recesses are substantially coaxially aligned.

11. An apparatus for absorbing energy from the release of an archery bow, comprising:

an elongated support structure having a substantially oval configuration with an outer frame and cross supports extending across the frame, the frame and the cross supports of the elongated support structure releaseably connectable to at least one vibration reduction insert;

the at least one vibration reduction insert having a substantially cylindrical shape and having at least one substantially C-shaped recess along an outer edge of the at least one vibration reduction insert; and a releasable fastener connected to one end of the elongated support structure, and the fastener releaseably connectable to the archery bow such that the elongated support structure is extendible in a cantilevered position relative to the archery bow.

12. The apparatus as stated in claim 11, further comprising:

the cross supports having a honeycomb configuration.

13. The apparatus as stated in claim 11, further comprising:

the cross supports having a cross-hatch configuration.

14. The apparatus as stated in claim 11, further comprising:

the cross supports having an arched cross-hatch configuration, wherein the cross supports have a substantially curvilinear configuration.

15. An apparatus for absorbing energy from the release of an archery bow, comprising:

at least one vibration reduction insert made from a vibration reduction material and having a first portion, a second portion, and a third portion, the first portion and the third portion are substantially similar discs with each having a pair of substantially C-shaped recesses extending therethrough, the second portion is a disc having an annular protruding ridge and a substantially C-shaped recess extending therethrough;

an elongated support structure releaseably connectable to the at least one vibration reduction insert; and a releasable fastener connected to one end of the support structure, the fastener releaseably connectable to the archery bow such that the support structure is extendible in a cantilevered position relative to the archery bow.

16. The apparatus as stated in claim 15, further comprising:

the support structure having a substantially oval configuration with an outer frame and cross supports extending across the frame, the frame and the cross supports connectable to the at least one vibration reduction insert.

17. The apparatus as stated in claim 16, further comprising:

the cross supports having a honeycomb configuration.

18. The apparatus as stated in claim 16, further comprising:

the cross supports having a cross-hatch configuration.

19. The apparatus as stated in claim 16, further comprising:

the cross supports having an arched cross-hatch configuration, wherein the cross supports have a substantially curvilinear configuration.

20. An apparatus for mounting at least one dampener and/or stabilizer to an archery bow, comprising:

an elongated support structure releaseably connectable to the at least one dampener and/or stabilizer, the support structure having a substantially oval configuration with an outer frame and cross supports extending across the frame, the frame and the cross supports are connectable to the at least one dampener and/or stabilizer, the cross supports having an arched cross-hatch configuration; and a releasable fastener connected to one end of the support structure, and the fastener releaseably connectable to the archery bow such that the support structure is extendible in a cantilevered position related to the archery bow.

* * * * *